US005687816A

United States Patent [19]

Wüsthof et al.

[11] Patent Number: 5,687,816

[45] Date of Patent: Nov. 18, 1997

[54] UNDERGROUND STORAGE SPACE

[75] Inventors: Peter Wüsthof, Lohr/Main; Erich Wirzberger, Neuhütten, both of Germany

[73] Assignee: Mannesmann Rexroth GmbH, Lohr/Main, Germany

[21] Appl. No.: 535,631

[22] Filed: Sep. 28, 1995

[30] Foreign Application Priority Data

Oct. 14, 1994 [DE] Germany ..... 44 36 768.6
Feb. 16, 1995 [DE] Germany ..... 195 05 130.0

[51] Int. Cl.[6] ..... B66B 13/24

[52] U.S. Cl. ..... 187/337; 187/205

[58] Field of Search ..... 187/337, 336, 187/338, 205

[56] References Cited

U.S. PATENT DOCUMENTS

| | | | |
|---|---|---|---|
| 1,178,814 | 4/1916 | Mau et al. | 187/337 |
| 2,588,518 | 3/1952 | Grushon | 187/205 |

FOREIGN PATENT DOCUMENTS

| | | |
|---|---|---|
| 931317 | 8/1955 | Germany . |
| 1246963 | 8/1967 | Germany . |
| 1279310 | 10/1968 | Germany . |
| 2242894 | 3/1974 | Germany . |
| 2317695 | 10/1974 | Germany . |
| 2816210 | 10/1979 | Germany . |
| 8005867 | 6/1980 | Germany . |
| 8005867 | 12/1980 | Germany . |
| 3535976 | 4/1987 | Germany . |
| 4033976 | 1/1992 | Germany . |
| 4105901 | 8/1992 | Germany . |
| 9217542 | 4/1993 | Germany . |
| 4209069 | 9/1993 | Germany . |
| 4304379 | 8/1994 | Germany . |
| 4311796 | 10/1994 | Germany . |
| 2231073 | 11/1990 | United Kingdom . |

*Primary Examiner*—Kenneth Noland
*Attorney, Agent, or Firm*—Martin A. Farber

[57] ABSTRACT

In an underground storage space, particularly for endangered goods, access is effected via a left the opening of which, leading into the storage space, can be closed by two covers which are arranged spaced apart from each other.

13 Claims, 5 Drawing Sheets

UNDERGROUND STORAGE SPACE

FIELD AND BACKGROUND OF THE INVENTION

The present invention relates to an underground storage space which is accessible via a lift. In previous underground storage spaces, there is a closing of the lift opening by a plate which travels on rollers. This requires expensive drive means and, in particular, measures for preventing a contamination, as by dirt, of both the travel paths and the drive means themselves. Furthermore, any damage to the closure plate from external sources may impair the operability of the closure plate.

SUMMARY OF THE INVENTION

The object of the invention is to create an underground storage space wherein the closing-off of the lift opening is substantially insensitive to dirt, while its operability is retained even in case of outer damage. Furthermore, actuation is to be effected with simple means.

In accordance with the invention, entrance to the storage space is attained by means of a lift. The lift opening is closed by a first cover having at least one swingable flap. A second cover closes the entrance below the first cover.

BRIEF DESCRIPTION OF THE DRAWINGS

With the above and other advantages in view, the present invention will become more clearly understood in connection with the detailed description of the preferred embodiments, when considered with the accompanying drawings of which.

DETAILED DESCRIPTION OF THE PREFERRED EMBODIMENTS

Figure 1:
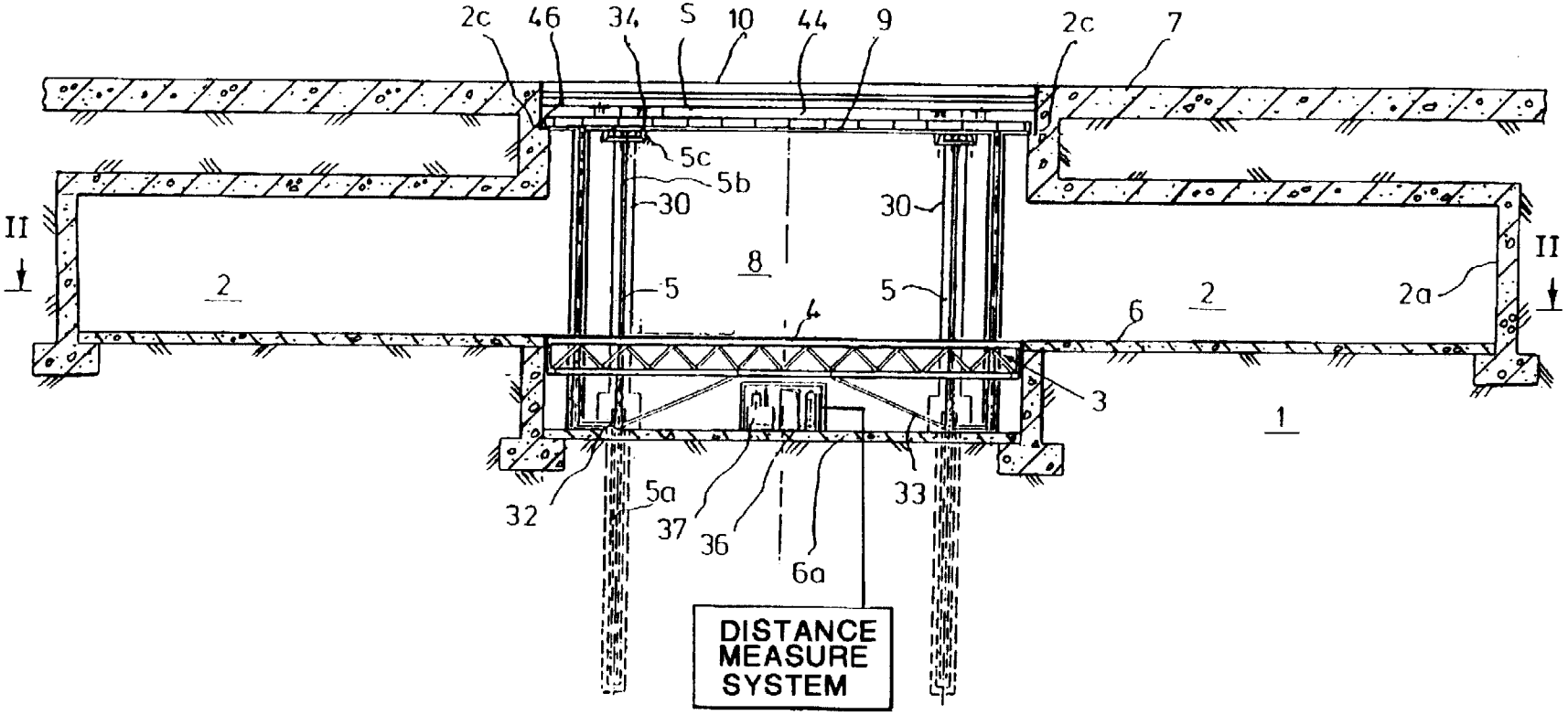
FIG. 1 shows a cross section along the line I—I of FIG. 3.
Figure 2:
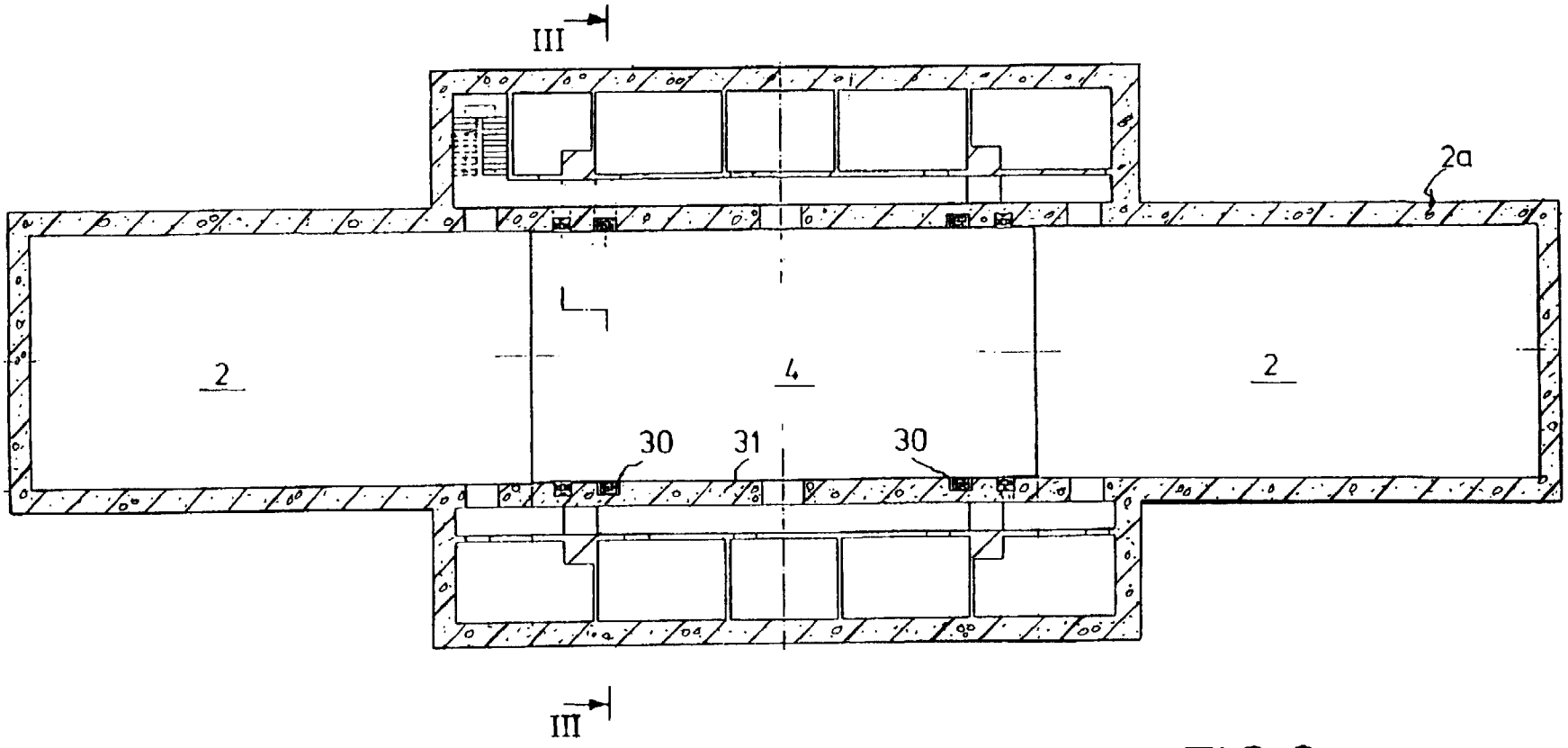
FIG. 2 shows a cross section along the line II—II of FIG. 1.
Figure 3:
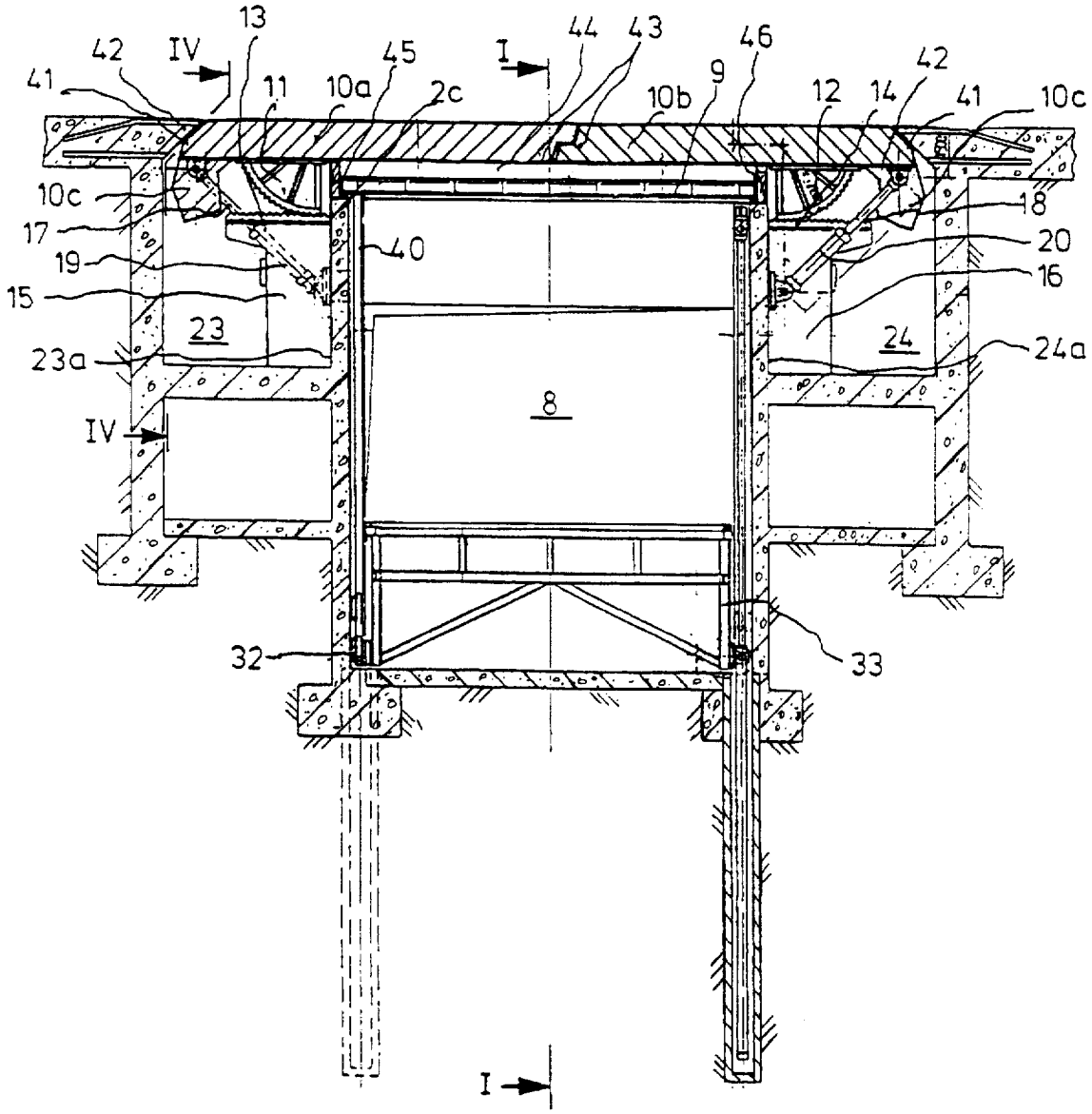
FIG. 3 shows a cross section along the line III—III of FIG. 2, with flaps closed.
Figure 4:
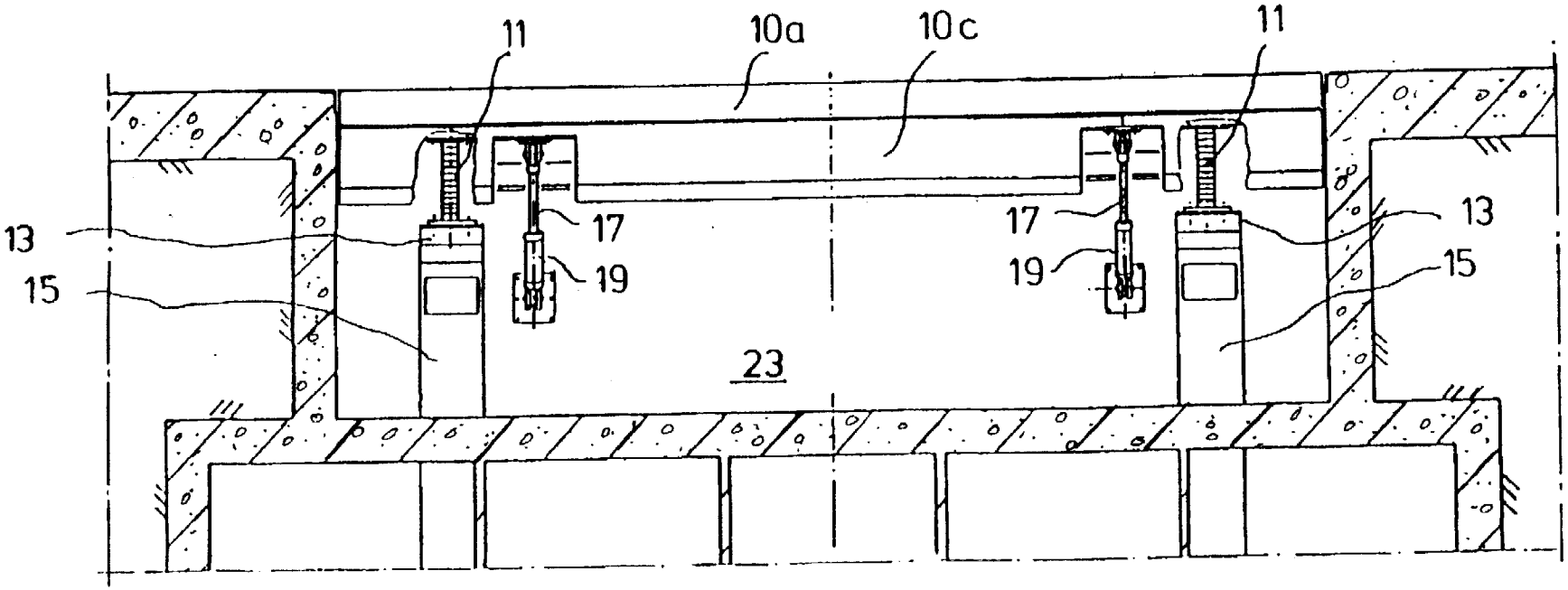
FIG. 4 shows a cross section along the line IV—IV of FIG. 3.
Figure 5:
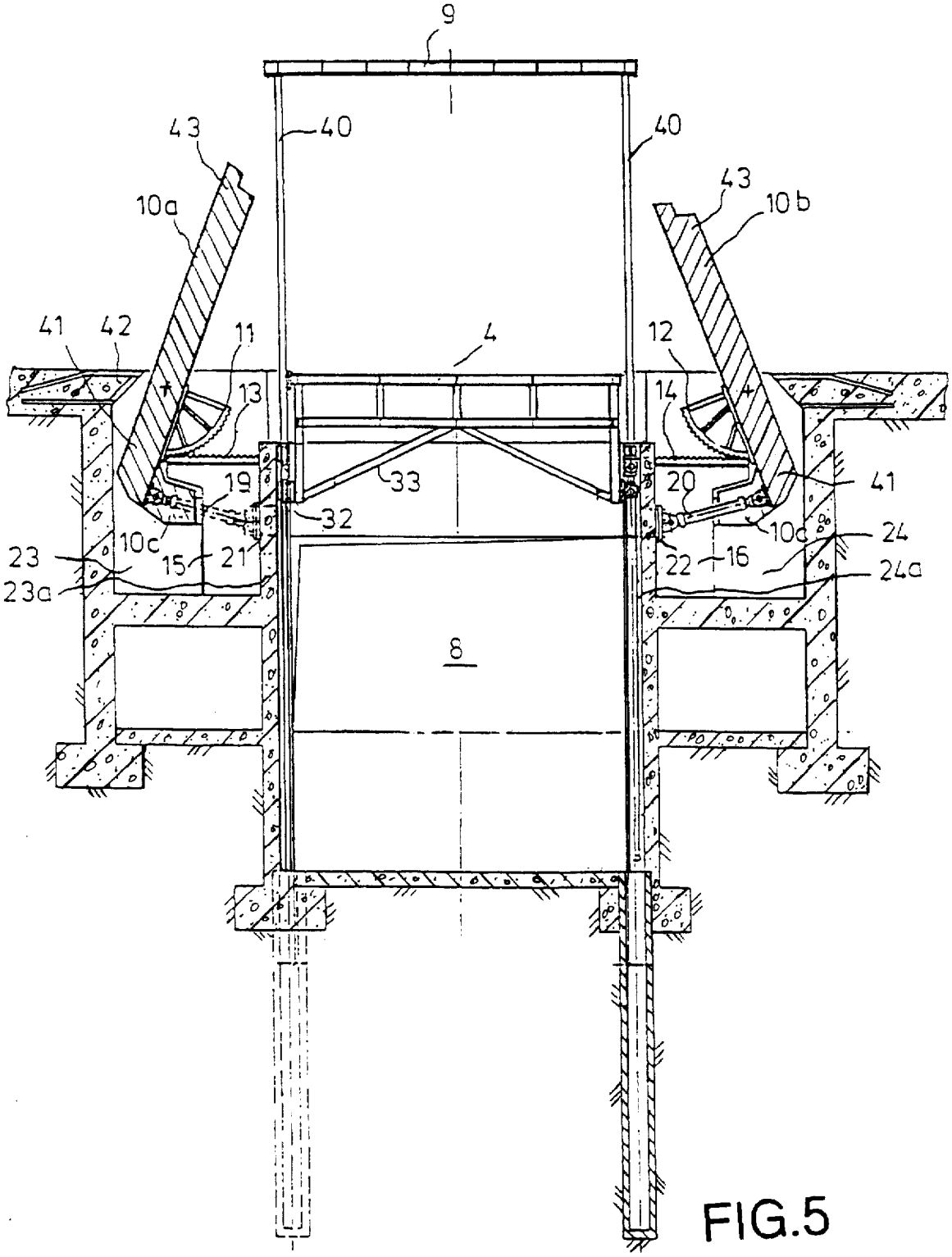
FIG. 5 shows a cross section along the line III—III of FIG. 2, with flaps open.

In FIG. 1, 1 is the earth in which storage spaces 2, or rooms, have been excavated and limited by masonry wall 2*a*. The storage spaces 2 are accessible via a lift 3 having a platform 4 which can be lifted by four hydraulic work cylinders 5 from a lower storage level 6, shown in FIG. 1, into the upper entrance level (FIG. 5). The lift opening 8 is closed and opened by two covers 9 and 10 arranged spaced apart by a distance S. By the use of the two covers which are arranged spaced apart from each other, a tight closing of the lift opening is assured even if the upper cover is damaged by external causes. The upper cover 10 is formed in accordance with FIGS. 3 and 5 by two flaps 10*a*, 10*b*. On the sides of the flaps 10*a*, 10*b* facing the lift opening 8 there are fastened toothed sector gears 11, 12 which are in form-locked engagement with stationary racks 13, 14. The racks are fastened on foundations 15, 16. Piston rods 17, 18 of actuating cylinders 19, 20 are pivoted to the outer end 41 of each flap. As shown in FIG. 4, two toothed sector gears 11, 12 with racks 13, 14 and two actuating cylinders 19, 20 spaced apart from each other are associated with each of the flaps 10*a*, 10*b*. Bottoms of the cylinders 19, 20 are pivotally fastened on wall brackets 21, 22 (FIG. 5). The flaps 10*a*, 10*b* have counterweights 10*c* so that only slight hydraulic forces need be provided by the actuating cylinders for the swinging of the flaps. The actuating cylinders are arranged together with the toothed sector gears and racks in chambers 23, 24 separated by walls 23*a*, 24*a*, from the lift opening 8. Upon the retraction of the piston rods, the toothed sector gears fastened on the flaps roll on the racks so that the flaps swing into their open position shown in FIG. 5 and thus release the lift opening, a reverse direction of roll of the sector gears providing for a closing of the opening.

The four cylinders 5 for the raising and lowering of the lift are arranged in recesses 30 in the masonry wall 31 on the side of the lift and the cylinder bodies 5*a* are fastened via brackets 32 to the underframe 33 of the lift. The piston rods 5*b* have their ends 5*c* fastened to support members 34 fastened in supporting manner in the masonry wall. By the piston rods 5*b* which are arranged fixed in position and the cylinder bodies 5*a* which are movable with the lift, the piston rods are stressed in tension in advantageous manner. The cylinders 5 are so controlled via a distance-measurement system that their stroke movement takes place in synchronism upon a moving in and out of the piston rods. The operating fluid necessary for the actuating of the work cylinders 5, 19 is provided from a hydraulic storage station 36 (FIG. 1) which is fed by a hydraulic unit 37. Storage station 36 and hydraulic unit 37 are arranged in protected manner below the platform 4 on the bottom 6*a* of the storage space.

The lower cover 9 is fastened to the platform 4 of the lift via four rods 40 so that the cover rises and descends with the platform 4. In the lowered position of the platform 4, the cover 9 lies via its periphery on wall projections 2*c* (FIG. 3) and, by the interpositioning of a surrounding seal 46, seals the lift opening off from the outside. In this position of the platform, the latter is borne by the cover via the rods 40. In this way the weight of the lift can be used as sealing force for the sealing-off of the lift opening via the lower cover 9.

The outer ends 41 of the flaps 10*a*, 10*b* forming the upper cover 10 have an oblique course which, in the closed position of the flaps rests in sealing fashion against correspondingly obliquely extending wall projections 42. The facing ends 43 of the flaps have shoulders corresponding to each which lie against each other also in sealing manner in the closed position of the flaps. In this way, the space 44 between upper and lower covers is also substantially protected from external influences. The upper region 45, 46 (FIG. 3) of the partition walls between the lift opening 8 and the chambers 23, 24 receiving the actuating cylinders 20 with toothed sector gears 11, 12 and racks 13, 14 form a sealing body which, in the closed position of the flaps 10*a*, 10*b*, sealingly separates the chambers 23, 24 from the space 44 between the two covers 9 and 10.

We claim:

1. An underground storage space comprising an entrance with a lift;

wherein the lift has an opening comprising a first cover and a second cover below the first cover, the first cover comprising a swingable flap;

the opening is closable by said first cover, and said second cover closes the entrance below said first cover; and rolling means supporting said first cover for translating said first cover toward said entrance with rotation of said first cover during a closure of said opening.

2. An underground storage space according to claim 1, wherein said second cover is spaced apart from said first cover.

3. An underground storage space according to claim 2, wherein said second cover is connected to said lift to form a unitary movable unit.

4. An underground storage space comprising an entrance with a lift;

wherein the lift has an opening comprising a first cover and a second cover below the first cover, the first cover comprising a swingable flap;

the opening is closable by said first cover, and said second cover closes the entrance below said first cover; and said underground storage space further comprises a stationary rack and a toothed sector gear which rolls on the rack;

wherein said flap is operable by a swinging movement which takes place via a rolling of said sector gear on said rack.

5. An underground storage space according to claim 1, further comprising a hydraulic actuating cylinder for actuating said flap.

6. An underground storage space comprising an entrance with a lift;

wherein the lift has an opening comprising a first cover and a second cover below the first cover, the first cover comprising a swingable flap;

the opening is closable by said first cover, and said second cover closes the entrance below said first cover; and said underground storage space further comprises a hydraulic actuating cylinder for actuating said flap; and swing means for swinging said flap, and a chamber covered by a part of said flap upon a closure of said flap;

wherein said actuating cylinder and said swing means are located in said chamber, said flap part extending above said swing means.

7. An underground storage space according to claim 6, further comprising a cylinder rod, operative with said cylinder;

wherein said cylinder rod of the actuating cylinder is pivoted to an end of said flap part.

8. An underground storage space comprising an entrance with a lift;

wherein the lift has an opening comprising a first cover and a second cover below the first cover, the first cover comprising a swingable flap;

the opening is closable by said first cover, and said second cover closes the entrance below said first cover;

said second cover is spaced apart from said first cover;

said second cover is connected to said lift to form a unitary movable unit;

said entrance has an enclosing wall having stops; and said second cover lies, in a lowered condition of said lift, on said stops and bears the weight of said lift.

9. An underground storage space according to claim 8, further comprising a surrounding seal arranged between said second cover and said wall.

10. An underground storage space according to claim 1, further comprising an operating cylinder for displacing said lift.

11. An underground storage space comprising an entrance with a lift;

wherein the lift has an opening comprising a first cover and a second cover below the first cover, the first cover comprising a swingable flap;

the opening is closable by said first cover, and said second cover closes the entrance below said first cover;

said underground storage space further comprises a plurality of operating cylinders for raising said lift;

a masonry wall disposed laterally of said lift, said operating cylinders being arranged in recesses of the masonry wall;

wherein said operating cylinders include cylinder bodies and piston rods;

said cylinder bodies are movable with the lift and are fastened to the lift; and ends of said piston-rods are fastened, fixed in position, on said masonry wall.

12. An underground storage space according to claim 11, further comprising a hydraulic storage station and a hydraulic unit which feeds to the hydraulic storage station operating fluid necessary for the actuating of said operating cylinders;

wherein said hydraulic unit and said storage station are located below said lift on a bottom of the storage space.

13. An underground storage space according to claim 11, further comprising a distance-measurement system; and wherein said operating cylinders are controlled for raising and for lowering said lift via said distance-measurement system in synchronism with movement of said lift upon retraction and extraction movements of said piston rods.

* * * * *